US005323875A

United States Patent [19]

Kennett

[11] Patent Number: 5,323,875

[45] Date of Patent: Jun. 28, 1994

[54] LADDER STABILIZER

[76] Inventor: Douglas A. Kennett, 255 Willow St., Woonsocket, R.I. 02895

[21] Appl. No.: 980,290

[22] Filed: Nov. 23, 1992

[51] Int. Cl.[5] ..... E06C 7/00

[52] U.S. Cl. ..... 182/214; 182/107

[58] Field of Search ..... 248/214, 107, 108, 229

[56] References Cited

U.S. PATENT DOCUMENTS

| | | | |
|---|---|---|---|
| 1,994,369 | 3/1935 | Risser | 182/107 |
| 2,592,006 | 4/1952 | Burke | 182/108 X |
| 2,720,354 | 11/1955 | Stanley | 182/214 X |
| 3,072,218 | 1/1963 | Peters | 182/214 |
| 3,715,012 | 2/1973 | Perry | 182/214 X |
| 4,061,203 | 12/1977 | Spencer et al. | 182/214 |
| 4,615,412 | 10/1986 | Clarke | 182/214 |
| 5,010,979 | 4/1991 | Shreve, III | 182/214 |
| 5,012,895 | 5/1991 | Santos | 182/214 X |
| 5,121,814 | 6/1992 | Southern | 182/214 |

FOREIGN PATENT DOCUMENTS

| | | | |
|---|---|---|---|
| 1193183 | 4/1959 | France | 182/214 |

*Primary Examiner*—Karen J. Chotkowski

*Attorney, Agent, or Firm*—Robert J. Doherty

[57] ABSTRACT

A stand off brace of preferably one-piece tubular construction for use with ladders in which the brace includes a central generally V-shaped apex which is adapted to extend into and between the ladder rails such that increased rigidity between the brace and ladder is brought about.

9 Claims, 1 Drawing Sheet

LADDER STABILIZER

BACKGROUND AND OBJECTS OF THE INVENTION

This invention relates to a ladder attachment and more particularly to a stand off brace or stabilizer for use in connection with a standard ladder for positioning the ladder away from the work surface and increasing the effective ladder width to increase stabilization thereof and to prevent the ladder from coming in direct contact with the supporting surface, namely, the wall of the building, whether such wall is a straight wall or a corner thereof.

There are numerous ladder braces or stabilizers presently in use and contemplated which present structures such that when the brace is attached to the ladder, the ladder in its use position is outwardly spaced from the supporting wall such as of a house or other building as when maintenance such as cleaning or painting is being performed. The main idea of these braces is to provide a wider stabilizing contact surface than the ladder would normally provide and also to position the ladder a greater distance away from the supporting surface so that people will not have to lean backwards a greater extent than is safe as when cleaning gutters or reaching wall areas to work upon.

Representative of such prior art devices are those shown in the following U.S. patents: U.S. Pat. No. 5,121,814 issued Jun. 16, 1992; U.S. Pat. No. 4,593,790 issued Jun. 10, 1986; U.S. Pat. No. 3,072,218 issued Jan. 8, 1963; and U.S. Pat. No. 2,592,006 issued Apr. 8, 1952. These devices generally either rely upon removable extensions to convert the braces from flat wall to corner wall use thus complicating their structure or utilize the ladder rungs as the area to which attachment between the brace and ladder is accomplished. Attachment to ladder rungs can conceivably interfere with the user's hand grasping such a rung for support during ladder use and inherently provides point attachment which is less strong and rigid than spaced lateral attachment such as by attachment to the laterally-spaced ladder rails. Also in those prior art devices which allow for attachment to the laterally-spaced rails, such is done in a single plane where the contact between the central brace portion and the rails is a face to face point contact which can lead to slippage or require an unnecessarily tight attachment mechanism.

Accordingly there remains a need for a stabilizing brace which can operate on both flat and corner wall surfaces and which avoids the above-indicated shortcomings of the prior art and yet which is easily manufactured, straightforward to use and of a rigid, safe construction.

These and other objects of the invention are accomplished by a stand off brace for a ladder having first and second side rails laterally-spaced comprising a rigid elongated frame having a pair of generally equal length first legs forwardly outwardly extending from each other so as to define a generally V-shaped central section and a pair of generally equal length legs outwardly inwardly extending from said first legs and in turn terminating in ends adapted to contact a vertically oriented wall at laterally-spaced points thereon so as to support the ladder at an outwardly spaced operational position with respect to said wall, said frame central portion adapted to extend between said ladder rails and project into and beyond the vertical plane defined thereby in said operational position with said first legs contacting said rails, and means for fixedly attaching said first legs to said rails in said position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
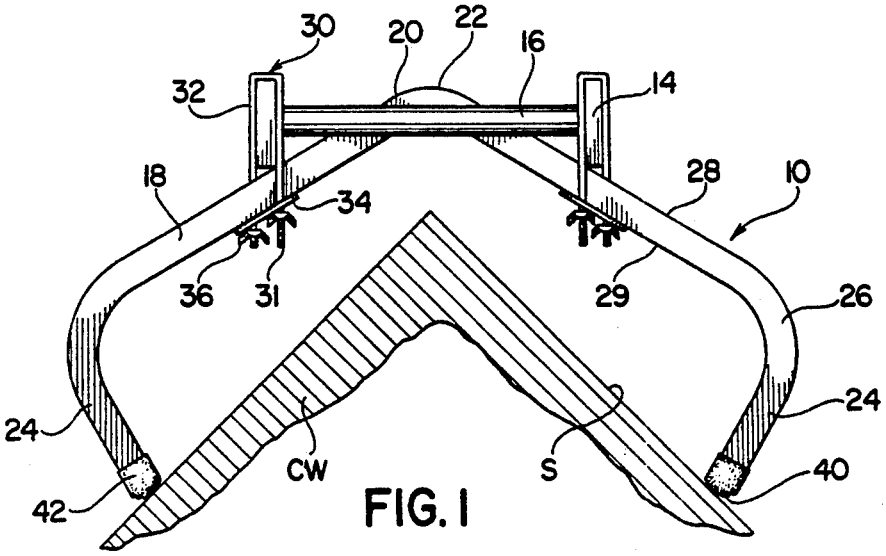
FIG. 1 is a top plan view of the stand off brace of the present invention attached to a ladder and the combination leaning against the corner of a building in a work position and supported adjacent corner walls thereof.
Figure 2:
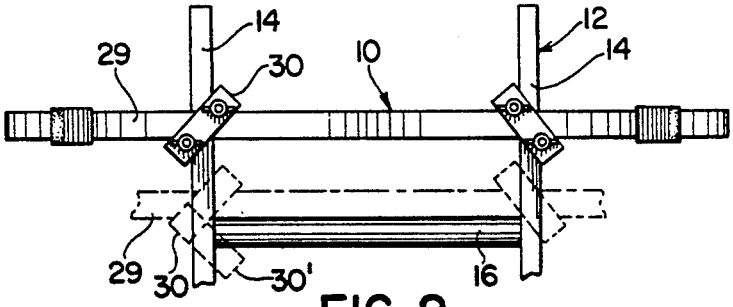
FIG. 2 is a front elevational view of the brace in use position attached to a ladder looking from the support wall towards the ladder.
Figure 3:
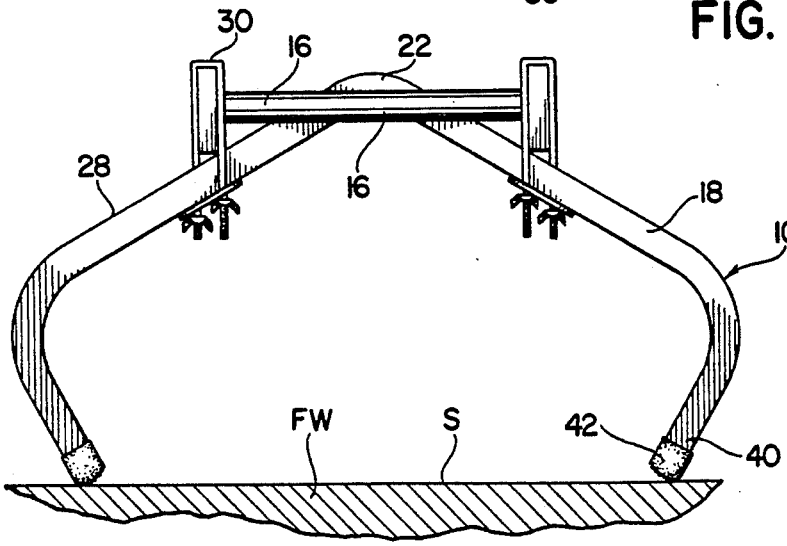
FIG. 3 is a plan view similar to FIG. 1 but showing the ladder and corner brace in its use position vis-a-vis a planar, that is, a flat, wall as distinguished from a corner wall.

Turning now to the drawings and particularly FIGS. 1 and 2 thereof, the device 10 of the present invention is adapted for use with a standard ladder 12 whether such ladder being an extension ladder or a single ladder as depicted. Such ladder includes a pair of side rails 14 which are laterally spaced from each other and a series of connecting rungs 16 which connect the rails 14 and which are vertically spaced from each other along the vertical extent of the ladder. Normally the ladder 12 exhibits side rails which have some forward to rear depth, that is, they are of a generally rectangular cross-sectional configuration and may be made of any suitable material including wood, metal or plastic.

The brace 10 includes a pair of forwardly outwardly extending first legs 18 connected at one pair of respective rearward ends so as to form a generally V-shaped central section 20 terminating in an apex 22. The forward ends of the legs 18 connect with a pair of second legs 24 which outwardly inwardly extend from a connecting area 26. Such connecting area 26 is generally a smooth curve to enable fabrication by bending techniques as is the apex 22. Accordingly, the overall brace appearance is somewhat trapezoidal or resembling the appearance of a flat haystack when viewed normal to the horizontal plane formed thereby. In that regard, it should be pointed out that the brace is essentially coplanar, that is, that the legs 18 and 24 are defined within the same plane although slight departures from such configuration could be accommodated.

Generally the frame including the legs 18 and 24 are formed from a single piece of hollow tubular stock preferably exhibiting a rectangular cross-sectional configuration and formed from an aluminum alloy composition although plastic or even other materials including wood could be utilized. As such, the first legs 18 include an inner flat surface 28 and an opposed outer flat surface 29. It is preferable that the inner surface 28 be flat such that it provides substantial vertical line contact between it and the outer edge surface of each of the rails 14 to which it is adapted for connection. In this regard, it will be apparent that the rounded or generally V-shaped apex 22 of the frame 20 extends inwardly into the interior ladder portions, that is, it extends past the forward plane defined by the forward terminal portions of the ladder rails 14. Further in this connection, the frame 20 is generally disposed at a position intermediate the spaced rungs 16 but can be positioned above the top rung 16 dependent on the jobs being performed by the worker using the ladder. In this regard if added rigidity is desired, although the above arrangement provides greater rigidity than is normally achievable by prior art devices, the frame 20 can be placed immediately adjacent to a rung 16 as shown in the dotted line representation of FIG. 2 such that it rests thereon and provides further resistance to downward frame movement relative to the ladder including the pivotal movement of the apex area 22. In addition, the clamp members can be disposed so that they, in effect, crisscross both both rail and adjacent rung portions on either side as shown by the dotted lines identified as 30.

Conventional attachment means 30 are provided which include an elongated U-shaped clamp member 32 threaded at both terminal ends and provided with an end plate 34 having laterally-spaced holes to receive the ends 31 and provided with nut means such as the wing nuts 36 depicted. In this way, the plate 34 engages the also preferably flat outer surface 30 of the first legs 18 while the U-shaped clamp encircles the rails 14, and upon tightening the wing nuts, a unitary relationship between the ladder and brace is accomplished. Inasmuch as the apex 22 extends inwardly and preferably at least not a great distance beyond the plane defined by the inner edges of the rails 14 at least to the extent that it would interfere with the ladder use, greater rigidity than normally accomplished is brought about.

Figure 1A:
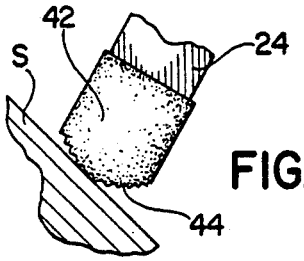
FIG. 1*a* is an enlarged partial view showing the contact between the wall surface and the brace second leg terminal end.

The second legs 24 terminate in ends 40 which are preferably provided with caps 42 which securely fit thereover and which are formed from a rubber or polymer composition which exhibits a high frictional characteristic such that slippage between the surfaces S of the corner wall CW or the flat wall FW is reduced. In this connection and as apparent from reference to FIG. 1*a*, the end surface of the caps 42 which is preferably rounded may be provided with a number of serrations or bumps 44 to increase the frictional contact between the wall surface S and the cap 42. Of course, the terminal end 40 does not necessarily have to be provided with a cap 42, but such is beneficial not only for the operational reasons relating to friction as elicited above but also so that possible sharp edges of end 40 will not mar the surfaces S.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A stand off brace for a ladder having first and second side laterally-spaced rails, which brace accommodates both corner and flat wall usage comprising a rigid elongated frame of one piece integral construction having a pair of generally equal length first legs having inner and outer ends respectively and joined at their inner ends to define a central section, said first legs each respectively forwardly and outwardly extending from said central section and from each other, and a pair of generally equal length second legs integral with said first legs and forwardly and inwardly extending from the other ends of said first legs and in turn terminating in outer terminal ends adapted to contact a vertically oriented wall at laterally-spaced points thereon so as to support the ladder at an outwardly spaced operational position with respect to said wall, said lateral spacing between said second leg terminal ends being substantially less than the maximum lateral spacing of said frame defined by the lateral distance between the outer ends of said first legs, said central section adapted to extend between said ladder rails and project into and beyond the vertical plane defined thereby in said operational position with said first legs contacting said rails, the means for fixedly attaching said first legs to said rails in said position, said central section being of a general V-shaped configuration adapted for disposition adjacent and in contact with a rung of said ladder.

2. The brace of claim 1, said first legs having opposed outer and inner surfaces with said outer surface adapted to contact said ladder rails and said inner surfaces directed towards said wall in said use position.

3. The brace of claim 1, said second leg ends including end caps for increasing the frictional contact between said second leg ends and said wall.

4. The brace of claim 2, said frame being of hollow generally rectangular configuration.

5. The brace of claim 4, said frame being an integral piece of formed metal.

6. The brace of claim 1, said frame and rail legs cooperating to form a generally incomplete trapezoidal configuration with said second leg terminal ends laterally-spaced from each other a distance substantially greater than the lateral spacing of said ladder rails and further said second end terminal ends outwardly spaced from where said frame central portion is attached to said rails.

7. The brace off claim 1, said second leg terminal ends having a convex arcuate configuration having inner, outer and an intermediate central arcuate segments wherein said brace is adapted to contact a supporting wall via said outer segments when the supporting wall is flat and via said central segments when the supporting wall is a corner.

8. The brace of claim 1, said V-shaped central section contacting said ladder rug at laterally-spaced points and positioned beneath said rung.

9. The brace of claim 8, said V-shaped central section positioned above said rung.

* * * * *